US012331262B2

(12) United States Patent
Eryu

(10) Patent No.: US 12,331,262 B2
(45) Date of Patent: Jun. 17, 2025

(54) LUBRICATING OIL COMPOSITION FOR INTERNAL COMBUSTION ENGINE

(71) Applicant: ENEOS CORPORATION, Tokyo (JP)

(72) Inventor: Shogo Eryu, Kanagawa (JP)

(73) Assignee: ENEOS CORPORATION, Tokyo (JP)

( * ) Notice: Subject to any disclaimer, the term of this patent is extended or adjusted under 35 U.S.C. 154(b) by 0 days.

(21) Appl. No.: 18/683,340

(22) PCT Filed: Sep. 28, 2022

(86) PCT No.: PCT/JP2022/036162
§ 371 (c)(1),
(2) Date: Feb. 13, 2024

(87) PCT Pub. No.: WO2023/054469
PCT Pub. Date: Apr. 6, 2023

(65) Prior Publication Data

US 2024/0343990 A1 Oct. 17, 2024

(30) Foreign Application Priority Data

Oct. 1, 2021 (JP) ..... 2021-162975

(51) Int. Cl.
*C10M 129/54* (2006.01)
*C10M 129/70* (2006.01)
(Continued)

(52) U.S. Cl.
CPC ..... *C10M 169/044* (2013.01); *C10M 129/54* (2013.01); *C10M 129/70* (2013.01);
(Continued)

(58) Field of Classification Search
CPC ..... C10M 169/044; C10M 129/54; C10M 129/70; C10M 133/06; C10M 133/08;
(Continued)

(56) References Cited

U.S. PATENT DOCUMENTS

2008/0234153 A1 9/2008 Matsui
2009/0075852 A1 3/2009 Yagishita et al.
(Continued)

FOREIGN PATENT DOCUMENTS

JP 2007-254559 A 10/2007
JP 2008-106199 A 5/2008
(Continued)

OTHER PUBLICATIONS

International Search Report dated Dec. 6, 2022, issued in PCT/JP2022/036162, with English translation thereof.
(Continued)

*Primary Examiner* — Prem C Singh
*Assistant Examiner* — Francis C Campanell
(74) *Attorney, Agent, or Firm* — GREENBLUM & BERNSTEIN, P.L.C.

(57) ABSTRACT

Provided is a lubricating oil composition for an internal combustion engine containing: (A) a lubricant base oil with a kinematic viscosity at 100° C. of 2.0 $mm^2/s$ to 5.0 $mm^2/s$; (B) 50 mass ppm to 2000 mass ppm of a molybdenum-based friction modifier based on the total amount of the composition as an amount of molybdenum; (C) a nitrogen-containing ashless friction modifier; (D) a succinimide or a derivative thereof as a dispersant; (E) an amine ashless antioxidant as an antioxidant; and (F) 1000 mass ppm to 2200 mass ppm of a metallic detergent based on the total amount of the composition as an amount of metal, wherein the amount of sulfated ash in the composition is 0.9 mass % or less, and a nitrogen management index is 0.60 or less. Provided is a lubricating oil composition for an internal combustion engine having improved fuel efficiency and oxidative stability, while maintaining low amount of sulfated ash.

4 Claims, 1 Drawing Sheet

(51) Int. Cl.

| | |
|---|---|
| ***C10M 133/06*** | (2006.01) |
| ***C10M 133/08*** | (2006.01) |
| ***C10M 133/12*** | (2006.01) |
| ***C10M 133/16*** | (2006.01) |
| ***C10M 133/20*** | (2006.01) |
| ***C10M 133/44*** | (2006.01) |
| ***C10M 135/10*** | (2006.01) |
| ***C10M 135/18*** | (2006.01) |
| ***C10M 137/10*** | (2006.01) |
| ***C10M 141/10*** | (2006.01) |
| ***C10M 143/00*** | (2006.01) |
| ***C10M 145/14*** | (2006.01) |
| ***C10M 161/00*** | (2006.01) |
| ***C10M 169/04*** | (2006.01) |
| *C10N 20/02* | (2006.01) |
| *C10N 20/04* | (2006.01) |
| *C10N 30/00* | (2006.01) |
| *C10N 30/04* | (2006.01) |
| *C10N 30/10* | (2006.01) |
| *C10N 40/25* | (2006.01) |

(52) U.S. Cl.
CPC ..... *C10M 133/06* (2013.01); *C10M 133/08* (2013.01); *C10M 133/12* (2013.01); *C10M 133/16* (2013.01); *C10M 133/20* (2013.01); *C10M 133/44* (2013.01); *C10M 135/10* (2013.01); *C10M 135/18* (2013.01); *C10M 137/10* (2013.01); *C10M 141/10* (2013.01); *C10M 143/00* (2013.01); *C10M 145/14* (2013.01); *C10M 161/00* (2013.01); *C10M 2205/02* (2013.01); *C10M 2207/144* (2013.01); *C10M 2207/284* (2013.01); *C10M 2209/084* (2013.01); *C10M 2215/102* (2013.01); *C10M 2215/26* (2013.01); *C10M 2215/28* (2013.01); *C10M 2215/30* (2013.01); *C10M 2219/044* (2013.01); *C10M 2219/068* (2013.01); *C10M 2223/045* (2013.01); *C10N 2020/02* (2013.01); *C10N 2020/04* (2013.01); *C10N 2030/04* (2013.01); *C10N 2030/10* (2013.01); *C10N 2030/45* (2020.05); *C10N 2040/25* (2013.01)

(58) Field of Classification Search
CPC ..... C10M 133/12; C10M 133/16; C10M 133/20; C10M 133/44; C10M 135/10; C10M 135/18; C10M 137/10; C10M 141/10; C10M 143/00; C10M 145/14; C10M 161/00; C10M 2205/02; C10M 2207/144; C10M 2207/284; C10M 2209/084; C10M 2215/102; C10M 2215/26; C10M 2215/28; C10M 2215/30; C10M 2219/044; C10M 2219/068; C10M 2223/045; C10M 133/56; C10N 2020/02; C10N 2020/04; C10N 2030/04; C10N 2030/10; C10N 2030/45; C10N 2040/25
USPC ..... 508/287
See application file for complete search history.

(56) References Cited

U.S. PATENT DOCUMENTS

| | | | | |
|---|---|---|---|---|
| 2010/0029520 | A1 | 2/2010 | Kamano | |
| 2011/0003725 | A1 | 1/2011 | Matsui et al. | |
| 2012/0053100 | A1* | 3/2012 | Radano | C10M 169/041 508/474 |
| 2017/0121626 | A1 | 5/2017 | Nakaya et al. | |
| 2018/0023026 | A1* | 1/2018 | Kusuhara | C10M 139/00 508/369 |
| 2019/0024009 | A1 | 1/2019 | Kusumoto et al. | |

FOREIGN PATENT DOCUMENTS

| | | | |
|---|---|---|---|
| JP | 2008-231189 | A | 10/2008 |
| JP | 2008-231192 | A | 10/2008 |
| JP | 2009-167278 | A | 7/2009 |
| JP | 2010-47667 | A | 3/2010 |
| JP | 2010-095662 | A | 4/2010 |
| JP | 2017-149830 | A | 8/2017 |
| WO | 2015/147270 | A1 | 10/2015 |
| WO | 2016/158971 | A1 | 10/2016 |
| WO | 2017/170769 | | 10/2017 |

OTHER PUBLICATIONS

International Preliminary Report on Patentability dated Apr. 2, 2024, including Written Opinion dated Dec. 6, 2022, issued in PCT/JP2022/036162, with English translation thereof.

* cited by examiner

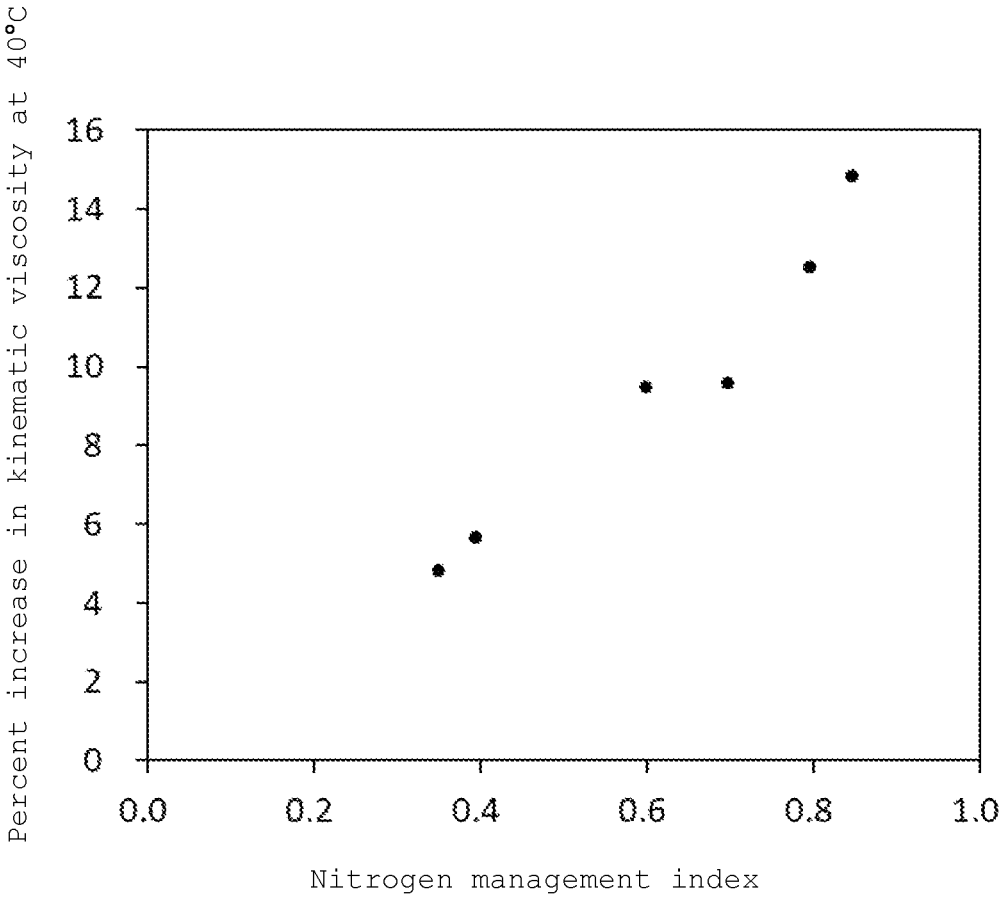
Percent increase in kinematic viscosity at 40°C
16
14
12
10
8
6
4
2
0
0.0
0.2
0.4
0.6
0.8
1.0
Nitrogen management index

LUBRICATING OIL COMPOSITION FOR INTERNAL COMBUSTION ENGINE

TECHNICAL FIELD

The present invention relates to a lubricating oil composition for an internal combustion engine. Specifically, it relates to a lubricating oil composition for an internal combustion engine with improved fuel efficiency and oxidative stability, while maintaining low amount of sulfated ash.

RERATED ART

Since the invention, internal combustion engines have been the source of power for various transportation means for many years. In recent years, the fuel efficiency required for an internal combustion engine continues to become higher. In order to meet this requirement, lubricating oils for internal combustion engines are also required to have high fuel efficiency.

Friction modifiers are used to improve the fuel efficiency of lubricating oils for internal combustion engines. For example, Patent Literature 1 discloses an engine oil having excellent effect of reducing fuel consumption, which contains a molybdenum-based friction modifier or an ashless friction modifier, as friction modifiers. Patent Literature 2 discloses a lubricating oil composition for an internal combustion engine, in which an increase in viscosity when biofuel is incorporated is suppressed, while reducing an adverse effect on exhaust gas purification devices and achieving excellent fuel efficiency. Patent Literature 3 discloses a lubricating oil composition in which cleanliness, abrasion resistance, and friction-reducing effect are improved in a well-balanced manner, while lower ash content is maintained.

CITATION LIST

Patent Literatures

Patent Literature 1: Japanese Patent Laid-Open No. 2010-095662

Patent Literature 2: International Publication No. WO 2017/170769

Patent Literature 3: Japanese Patent Laid-Open No. 2017-149830

SUMMARY OF INVENTION

Technical Problem

Lubricating oils for internal combustion engines are required to have various performances other than fuel efficiency and low amount of sulfated ash. For example, when a lubricating oil for an internal combustion engine with poor oxidative stability is used over a long period of time, a deterioration generates, and the acid value and the kinematic viscosity increase. In the techniques according to Patent Literatures 1 to 3, it has been difficult to obtain a lubricating oil for an internal combustion engine that has not only fuel efficiency and low amount of sulfated ash but also oxidative stability.

It is an object of the present invention to provide a lubricating oil composition for an internal combustion engine with improved fuel efficiency and oxidative stability, while maintaining low amount of sulfated ash.

Solution to Problem

In order to achieve a lubricating oil composition (which may be hereinafter referred to as simply "composition") for an internal combustion engine with improved fuel efficiency and oxidative stability, while maintaining low amount of sulfated ash, the inventors have made diligent investigation. Then, they have confirmed that the problems above are solved by combining specific components (A) to (F) and adjusting the nitrogen management index to 0.60 or less, thereby accomplishing the present invention.

The present invention has accomplished based on such findings and is as follows.

<1> A lubricating oil composition for an internal combustion engine containing: (A) a lubricant base oil with a kinematic viscosity at 100° C. of 2.0 $mm^2/s$ to 5.0 $mm^2/s$; (B) 50 mass ppm to 2000 mass ppm of a molybdenum-based friction modifier based on the total amount of the composition as an amount of molybdenum; (C) a nitrogen-containing ashless friction modifier; (D) a succinimide or a derivative thereof as a dispersant; (E) an amine ashless antioxidant as an antioxidant; and (F) 1000 mass ppm to 2200 mass ppm of a metallic detergent based on the total amount of the composition as an amount of metal, wherein the amount of sulfated ash based on the total amount of the composition is 0.9 mass % or less, a nitrogen management index represented by the following formula is 0.60 or less: formula (A): (N(B)*1.1+N(C)*1.9)/(N(D)+N(E)*1.2) wherein N(B) is an amount of nitrogen (mass ppm) derived from the molybdenum-based friction modifier based on the total amount of the composition, N(C) is an amount of nitrogen (mass ppm) derived from the nitrogen-containing ashless friction modifier based on the total amount of the composition, N(D) is an amount of nitrogen (mass ppm) derived from the succinimide or a derivative thereof based on the total amount of the composition, and N(E) is an amount of nitrogen (mass ppm) derived from the amine ashless antioxidant based on the total amount of the composition.

<2> The lubricating oil composition for an internal combustion engine according to <1>, wherein N(C) is 10 mass ppm or more, N(D) is 350 mass ppm or more, and N (E) is 410 mass ppm or more.

<3> The lubricating oil composition for an internal combustion engine according to <1> or <2>, further containing (G) a viscosity index improver, wherein the viscosity index improver has a Mw/Mn (weight-average molecular weight/number-average molecular weight) of 2.3 or more.

<4> The lubricating oil composition for an internal combustion engine according to any one of <1> to <3>, wherein a content of the molybdenum-based friction modifier is 500 mass ppm to 1000 mass ppm based on the total amount of the composition as an amount of molybdenum.

<5> The lubricating oil composition for an internal combustion engine according to any one of <1> to <4>, wherein the nitrogen-containing ashless friction modifier is at least one selected from an amino acid compound, an amine compound, a urea compound, and a fatty acid ester compound that all have an alkyl group, an alkenyl group, or an acyl group with 12 to 30 carbon atoms, and derivatives thereof.

Advantageous Effect of Invention

According to the lubricating oil composition for an internal combustion engine of the present invention, a lubricating oil composition for an internal combustion engine with improved fuel efficiency and oxidative stability, while maintaining low amount of sulfated ash, can be provided.

BRIEF DESCRIPTION OF DRAWING

FIG. 1 is a graph showing a relationship of the nitrogen management index and the percent increase in kinematic viscosity at 40° C. after a mixed gas was introduced continuously for 48 hours in the lubricating oil compositions of Examples 1 to 3 and Comparative Examples 1 to 3.

DESCRIPTION OF EMBODIMENT

[A] Lubricant Base Oil

The lubricant base oil used in the lubricating oil composition of the present invention may be any of a mineral base oil or a synthetic base oil. In the lubricating oil composition of the present invention, a mineral base oil is preferably used as a lubricant base oil.

As a mineral base oil, distillate oil obtained by atmospheric distillation of crude oil can be used. Furthermore, a lubricating oil fraction obtained by further distilling this distillate oil under reduced pressure and refining the distillate oil by various refining processes can also be used. As the refining processes, hydrorefining, solvent extraction, solvent dewaxing, hydrodewaxing, sulfuric acid treatment, white clay treatment, and the like can be appropriately combined. A lubricant base oil that can be used in the lubricating oil composition of the present invention can be obtained by combining these refining processes in an appropriate order. It is also possible to use a mixture of a plurality of refined oils with different properties obtained by subjecting different crude oils or distillate oils to a combination of different refining processes.

As the mineral base oils used in the lubricating oil composition of the present invention, it is preferable to use those belonging to Group III base oils in the API classification. The API Group III base oils are mineral base oils with a sulfur content of 0.03 mass % or less, a saturated content of 90 mass % or more, and a viscosity index of 120 or more. Multiple types of Group III base oils may be used, or only one type may be used.

As the mineral base oils used in the lubricating oil composition of the present invention, those belonging to Group II base oils in the API classification can also be used. The API Group II base oil are mineral base oils with a sulfur content of 0.03 mass % or less, a saturated content of 90 mass % or more, and a viscosity index of 80 or more and less than 120. Multiple types of Group II base oil may be used, and only one type may be used.

The lubricating oil composition of the present invention may contain only a mineral base oil as a lubricant base oil or may contain other lubricant base oils.

In the lubricating oil composition of the present invention, a synthetic base oil may be used as a lubricant base oil. Examples of the synthetic base oil include poly-α-olefins and hydrogenated products thereof, isobutene oligomers and hydrogenated products thereof, isoparaffins, alkylbenzenes, alkylnaphthalenes, diesters, polyol esters, polyoxyalkylene glycols, dialkyl diphenyl ethers, polyphenyl ethers, and mixtures thereof. Among them, poly-α-olefins are preferable. Typically, examples of the poly-α-olefins include oligomers or cooligomers (such as 1-octene oligomers, decene oligomers, and ethylene-propylene cooligomers) of α-olefins having 2 to 32 carbon atoms, preferably 6 to 16 carbon atoms and hydrogenated products thereof.

The lubricant base oil contained in the lubricating oil composition of the present invention has a kinematic viscosity at 100° C. of 2.0 $mm^2/s$ to 5.0 $mm^2/s$. The lubricant base oil contained in the lubricating oil composition of the present invention has a kinematic viscosity at 100° C. of preferably 3.0 $mm^2/s$ or more, more preferably 3.3 $mm^2/s$ or more, further preferably 3.5 $mm^2/s$ or more. Furthermore, the upper limit is preferably 4.8 $mm^2/s$ or less, more preferably 4.6 $mm^2/s$ or less, further preferably 4.4 $mm^2/s$ or less. Examples of the specific range include preferably 3.0 $mm^2/s$ to 4.8 $mm^2/s$, more preferably 3.3 $mm^2/s$ to 4.6 $mm^2/s$, further preferably 3.5 $mm^2/s$ to 4.4 $mm^2/s$. When the lubricant base oil has a kinematic viscosity at 100° C. of 5.0 $mm^2/s$ or less, a sufficient fuel efficiency can be achieved. Further, when the lubricant base oil has a kinematic viscosity at 100° C. of 2.0 $mm^2/s$ or more, the formation of an oil film at the lubricated location can be ensured, and the evaporation loss of the lubricating oil composition can also be reduced.

The kinematic viscosity at 100° C. means the kinematic viscosity in the state where all lubricant base oils are mixed, that is, the kinematic viscosity of entire base oils. That is, it does not mean the kinematic viscosity of a specific lubricant base oil when a plurality of base oils are included.

In this description, the "kinematic viscosity at 100° C." means a kinematic viscosity at 100° C. measured according to ASTM D-445.

In the lubricating oil composition of the present invention, the content of the lubricant base oil is, for example, 50 mass % to 95 mass %, preferably 60 mass % to 95 mass %, more preferably 65 mass % to 90 mass %, further preferably 70 mass % to 90 mass %, based on the total amount of the composition.

[B] Molybdenum-Based Friction Modifier

The lubricating oil composition of the present invention contains a molybdenum-based friction modifier. The molybdenum-based friction modifier is preferably molybdenum dithiocarbamate (which may be hereinafter referred to as simply MoDTC). When the lubricating oil composition of the present invention contains a molybdenum-based friction modifier, the friction coefficient can be reduced. One molybdenum-based friction modifier may be used alone, or two or more thereof may be used in combination at any ratio.

As MoDTC, a compound represented by formula (1) below can be used, for example.

[Formula 1]

(Formula 1)

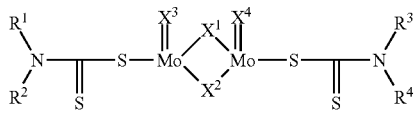

In formula (1) above, $R^1$ to $R^4$ each may be the same or different, an alkyl group having 2 to 24 carbon atoms or an (alkyl) aryl group having 6 to 24 carbon atoms, preferably an alkyl group having 4 to 13 carbon atoms or an (alkyl) aryl group having 10 to 15 carbon atoms. The alkyl group may be any of a primary alkyl group, a secondary alkyl group, or a tertiary alkyl group, and linear or branched. The "(alkyl) aryl group" means "an aryl group or an alkylaryl group". In the alkylaryl group, the position of substitution of the alkyl group on the aromatic ring is arbitrary. $X^1$ to $X^4$ are each independently a sulfur atom or an oxygen atom, and at least one of $X^1$ to $X^4$ is a sulfur atom.

Examples of molybdenum-based friction modifiers other than MoDTC can include molybdenum-based friction modifiers containing molybdenum dithiophosphate, molybdenum oxide, molybdenum acid, molybdate salts such as ammonium salts, molybdenum disulfide, molybdenum sulfide, molybdic acid sulfide, or sulfur. As the molybdenum-based friction modifiers other than MoDTC, it is preferable to use molybdate dialkylamine salt.

The amount of molybdenum derived from the molybdenum-based friction modifier is 50 mass ppm to 2000 mass ppm based on the total amount of the composition. The amount of molybdenum derived from the molybdenum-based friction modifier is preferably 200 mass ppm or more, more preferably 500 mass ppm or more. The upper limit is preferably 1800 mass ppm or less, more preferably 1500 mass ppm or less, further preferably 1000 mass ppm or less. Examples of the specific range include preferably 200 mass ppm to 1800 mass ppm, more preferably 500 mass ppm to 1500 mass ppm, further preferably 500 mass ppm to 1000 mass ppm. When the molybdenum content is 50 mass ppm or more, the fuel efficiency can be improved. On the other hand, when the molybdenum content is 2000 mass ppm or less, the storage stability of the lubricating oil composition can be enhanced. The amount of molybdenum in the oil is measured according to JPI-5S-62 by the inductively coupled plasma emission spectrometry (intensity ratio method (internal standard method)).

[C] Nitrogen-Containing Ashless Friction Modifier

The lubricating oil composition of the present invention contains a nitrogen-containing ashless friction modifier. In this description, the ashless friction modifier means a friction modifier free from metal elements.

The nitrogen-containing ashless friction modifier is preferably at least one selected from an amino acid compound, an amine compound, a urea compound, and a fatty acid ester compound that all have an alkyl group, an alkenyl group, or an acyl group with 12 to 30 carbon atoms, and derivatives thereof.

When the lubricating oil composition of the present invention contains the ashless friction modifier as a component (C), the friction coefficient can be reduced. In the lubricating oil composition of the present invention, ashless friction modifiers as the component (C) may be used alone, or in combination of two or more thereof at any ratio. Further, other types of ashless friction modifiers may also be contained.

(Amino Acid Compound Having an Alkyl Group, an Alkenyl Group, or an Acyl Group with 12 to 30 Carbon Atoms)

Examples of the amino acid compound can include a compound represented by formula (2) below.

[Formula 2]

Formula (2)

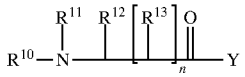

Here, $R^{10}$ is an alkyl group, an alkenyl group, or an acyl group with 12 to 30 carbon atoms, $R^{11}$ is an alkyl group having 1 to 4 carbon atoms or hydrogen, and $R^{12}$ is hydrogen or an alkyl group having 1 to 10 carbon atoms. This alkyl group may have a linear, branched, or cyclic structure, and carbon atoms may be substituted with heteroatoms or modified with functional groups such as hydroxyl, carboxyl, or amino groups. $R^{13}$ is an alkyl group having 1 to 4 carbon atoms or hydrogen, n is 0 or 1, and Y is a functional group having active hydrogen, a hydrocarbon having the functional group, a metal salt or ethanolamine salt of the functional group, or a methoxy group. In formula (2), the functional group having active hydrogen of Y is preferably a hydroxyl group, an amino group, or the like.

The ashless friction modifier as a component (E) is preferably (Z)—N-methyl-N-(1-oxo-9-octadecynyl) glycine (alias: N-oleoyl sarcosine) in which $R^{10}$ is an acyl group having 18 carbon atoms (oleoyl group), $R^{11}$ is a methyl group, $R^{12}$ is hydrogen, Y is a hydroxyl group, and n is 0, for improving the sustainability of frictional properties effect.

$$R^{20}\text{—(N—}R^{21}\text{)—}R^{22} \quad (3)$$

wherein $R^{20}$ is an alkyl group, an alkenyl group, or an acyl group with 12 to 30 carbon atoms, $R^{21}$ and $R^{22}$ are each independently hydrogen, an alkyl group, an alkenyl group, an acyl group, or a hydroxyalkyl group.

Examples of the amine compound represented by formula (3) include oleyl amine and stearyl amine. Oleyl amine is preferable.

Further, the amine compound represented by formula (3) is preferably 2,2'-(octadecane-1-ylimino) diethanol.

(Urea Compound that has an Alkyl Group, an Alkenyl Group, or an Acyl Group with 12 to 30 Carbon Atoms)

The urea compound is preferably a compound having a structure represented by formula (4) below.

$$R^{30}\text{—NH—CO—NH}_2 \quad (4)$$

wherein $R^{30}$ is an alkyl group, an alkenyl group, or an acyl group with 12 to 30 carbon atoms.

The urea compound is preferably an aliphatic urea compound, more preferably octadecenyl urea.

(Fatty Acid Ester Compound that has an Alkyl Group, an Alkenyl Group, or an Acyl Group with 12 to 30 Carbon Atoms)

The fatty acid ester compound means a compound formed by an ester bond between a carboxyl group as a fatty acid and an alcohol. Examples of the fatty acid ester compound include esters of linear or branched fatty acids and aliphatic monohydric or aliphatic polyhydric alcohols. The fatty acid may be a saturated fatty acid or an unsaturated fatty acid. These fatty acid ester compounds may have 7 to 31 carbon atoms, for example. The fatty acid ester compound is preferably an ester of a fatty acid and an aliphatic polyhydric alcohol, more preferably an ester of a linear fatty acid and an aliphatic polyhydric alcohol, further preferably an ester of a linear unsaturated fatty acid and an aliphatic polyhydric alcohol. These esters of aliphatic polyhydric alcohols may be complete esters or partial esters, preferably partial esters. As the ester of these aliphatic polyhydric alcohols, glycerin monooleate is preferable.

In the alkyl group, the alkenyl group, or the acyl group having 12 to 30 carbon atoms, the number of carbon atoms is preferably 14 to 24, more preferably 16 to 20, further preferably 18. The alkyl group, the alkenyl group, or the acyl group having 12 to 30 carbon atoms is most preferably an octadecyl group, a 9-octadecenyl group, or an oleoyl group. The alkyl group, the alkenyl group, or the acyl group may be linear or branched but is preferably linear.

The lower limit of the amount of nitrogen derived from the nitrogen-containing ashless friction modifier as the component (C) is preferably 10 mass ppm or more, more preferably 50 mass ppm or more, further preferably 100 mass ppm or more. The upper limit is preferably 500 mass ppm or less, more preferably 400 mass ppm or less, further preferably 300 mass ppm or less, based on the total amount of the composition. Examples of the specific range of the amount of nitrogen derived from the ashless friction modifier preferably include 10 mass ppm to 500 mass ppm, more preferably 50 mass ppm to 400 mass ppm, further preferably 100 mass ppm to 300 mass ppm. When the amount of nitrogen derived from the ashless friction modifier is 10 mass ppm or more, the friction coefficient can be reduced.

The content of the ashless friction modifier is preferably 0.001 mass % to 5.0 mass %, more preferably 0.01 mass % to 3.0 mass %, further preferably 0.1 mass % to 2.0 mass %, based on the total amount of the composition.

[D] Succinimide or Derivative Thereof

The lubricating oil composition of the present invention contains a succinimide or a derivative thereof as a dispersant. As the succinimide or a derivative thereof, one used as a dispersant in the field of lubricating oil compositions for internal combustion engines can be used. The succinimide may be any of a boron-free succinimide or a boron-containing succinimide but is preferably a boron-free succinimide. Use of a boron-free succinimide can prevent a rise in amount of sulfated ash due to an increase in boron content.

The boron-free succinimide means a succinimide in which the amino group and/or imino group are not partially or completely neutralized or amidated with boric acid or the like, where the boron content is, for example, 0.1 mass % or less relative to the amount of the succinimide.

As the succinimide, a succinimide or a derivative thereof having at least one alkyl group or alkenyl group in a molecule can be used, for example. Examples of the succinimide having at least one alkyl group or alkenyl group in a molecule can include a compound represented by formulas (5) or (6) below.

[Formula 5]

(Formula 5)

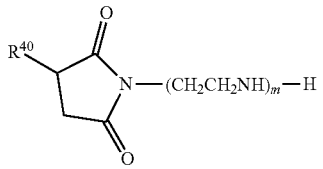

[Formula 6]

(Formula 6)

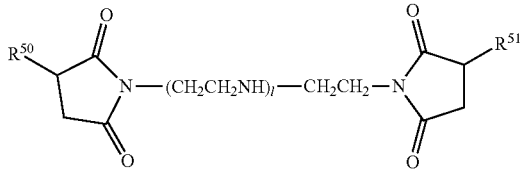

In formula (5), R: represents an alkyl or alkenyl group having 40 to 400 carbon atoms, and m represents an integer of 1 to 5, preferably 2 to 4. $R^{40}$ preferably has 60 to 350 carbon atoms.

In formula (6), R and Reach independently represent an alkyl or alkenyl group having 40 to 400 carbon atoms, and they may be a combination of different groups. 1 represents an integer of 0 to 4, preferably 1 to 4, more preferably 1 to 3. $R^{50}$ and $R^{51}$ preferably have 60 to 350 carbon atoms.

When the number of carbon atoms in $R^{40}$, $R^{50}$, and $R^{51}$ in formulas (5) and (6) is the lower limit or more, good solubility in the lubricant base oil can be achieved.

The alkyl or alkenyl group ($R^{40}$, $R^{50}$, and $R^{51}$) in formulas (5) and (6) may be linear or branched. Preferable examples thereof can include branched alkyl groups and branched alkenyl groups derived from oligomers of olefins such as propylene, 1-butene, and isobutene, or cooligomers of ethylene and propylene. Among these, branched alkyl or alkenyl groups derived from oligomers of isobutene, conventionally called polyisobutylene, or polybutenyl groups are most preferable.

The alkyl or alkenyl group ($R^{40}$, $R^{50}$, and $R^{51}$) in formulas (5) and (6) suitably has a number-average molecular weight of 800 to 8000, preferably 2000 to 7000. The number-average molecular weight means a value (molecular weight obtained in terms of polystyrene) determined by gel permeation chromatography (GPC).

The amount of nitrogen derived from the succinimide or a derivative thereof contained in the lubricating oil composition of the present invention is preferably 350 mass ppm or more, more preferably 370 mass ppm or more, further preferably 400 mass ppm or more, based on the total amount of the lubricating oil composition. The upper limit is preferably 1000 mass ppm or less, more preferably 800 mass ppm or less, further preferably 600 mass ppm or less. Examples of the specific range include preferably 350 mass ppm to 1000 mass ppm, more preferably 370 mass ppm to 800 mass ppm, further preferably 400 mass ppm to 600 mass ppm. When the amount of nitrogen derived from the succinimide or a derivative thereof is within the range, a low amount of sulfated ash and cleanliness can be ensured.

[E] Amine Ashless Antioxidant

The lubricating oil composition of the present invention contains an amine ashless antioxidant as an antioxidant. As the amine ashless antioxidant, one used in the field of lubricating oil compositions for internal combustion engines can be used. The amine ashless antioxidant is preferably alkyl diphenylamine having a structure of formula (7) below.

[Formula 7]

Formula (7)

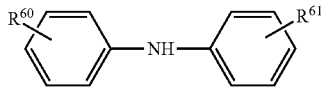

In the formula, $R^{60}$ and $R^{61}$ may be the same or different and each represent a hydrogen atom or an alkyl group having 1 to 16 carbon atoms. However, not all $R^{60}$ and $R^{61}$ are hydrogen at the same time. Examples of the alkyl group represented by $R^{60}$ and $R^{61}$ include a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, and a hexadecyl group (these alkyl groups may be linear or branched).

Among them, a nonyl group that is a linear alkyl group having 9 carbon atoms is preferable.

In the lubricating oil composition of the present invention, the content of the amine ashless antioxidant is preferably 410 mass ppm or more, more preferably 450 mass ppm or more, based on the total amount of the composition. Further, 1500 mass ppm or less is preferable, and 1200 mass ppm or less is more preferable. Examples of the specific range preferably include 410 mass ppm to 1500 mass ppm, more preferably 450 mass ppm to 1200 mass ppm. When the content of the amine ashless antioxidant is the lower limit or more, better oxidative stability can be obtained, and when it is the upper limit or less, the state where the amine ashless antioxidant is stably dissolved in the lubricating oil composition can be maintained.

[F] Metallic Detergent

The lubricating oil composition of the present invention contains a metallic detergent. As the metallic detergent, calcium-based detergents, magnesium-based detergents, and/or barium-based detergents can be used, for example. These detergents may be overbased with boric acid, a borate, carbonic acid, or a carbonate. As the metallic detergent, metallic detergents having a salicylate group, metallic detergents having a sulfonate group, or metallic detergents having a phenate group can be used. Metallic detergents having a salicylate group are preferably used.

When the lubricating oil composition of the present invention contains a metallic detergent, examples of the specific range of the amount of metal derived from the metallic detergent include 1000 mass ppm to 2200 mass ppm, more preferably 1200 mass ppm to 2200 mass ppm, further preferably 1400 mass ppm to 2100 mass ppm, based on the total amount of the composition. In this description, the content of each element such as calcium, magnesium, zinc, boron, phosphorus, and molybdenum in oil is measured by inductively coupled plasma emission spectrometry (intensity ratio method (internal standard method)) according to JPI-5S-62, unless otherwise specified. When the amount of metal derived from the metallic detergent is 2200 mass ppm or less, the amount of sulfated ash can be reduced, and the friction coefficient can also be reduced.

Examples of the range of the base number of the metallic detergent used in the lubricating oil composition of the present invention preferably include 150 mgKOH/g to 600 mgKOH/g, more preferably 200 mgKOH/g to 500 mgKOH/g. In this description, the base number of the metallic detergent is a value measured according to 9 of JIS K 2501:2003.

[G] Viscosity Index Improver

The lubricating oil composition of the present invention preferably contains a viscosity index improver. The viscosity index improver refers to a compound having a function of reducing changes in viscosity of a lubricating oil due to changes in temperature by adding it to the lubricating oil.

As the viscosity index improver, any viscosity index improver used in the field of lubricating oil compositions can be used without limitation, as long as the effects of the present invention are obtained. Examples thereof can include polybutene (PB), polyisobutene (PIB), ethylene-propylene copolymer (EPC), olefin copolymer (OCP), poly (meth)acrylate (PMA), and styrene-diene copolymer (SDC). As the viscosity index improver, olefin copolymer (OCP) or poly(meth)acrylate (PMA) is preferable, and poly(meth) acrylate (PMA) is more preferable. Use of poly(meth) acrylate (PMA) can maintain good viscosity index.

As the poly(meth)acrylate (PMA), any of dispersed poly (meth)acrylate, non-dispersed poly(meth)acrylate, and comb-shaped poly(meth)acrylate may be used. A comb-shaped poly(meth)acrylate is preferable.

In this description, "dispersed poly(meth)acrylate" refers to a poly(meth)acrylate compound having a functional group containing a nitrogen atom, and "non-dispersed poly(meth) acrylate" refers to a poly(meth)acrylate compound that does not have a functional group containing a nitrogen atom. Examples of dispersed or non-dispersed poly(meth)acrylate can include a poly(meth)acrylate having a proportion of the (meth)acrylate structural unit represented by formula (8) below in all monomer units in the polymer of 10 to 90 mol %.

[Formula 8]

(Formula 8)

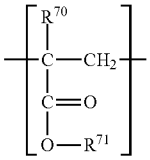

wherein $R^{70}$ represents hydrogen or a methyl group, $R^{71}$ represents a linear or branched hydrocarbon group having 1 to 5 carbon atoms.

When the proportion of the (meth)acrylate structural unit represented by formula (8) in all monomer units in the polymer exceeds 90 mol %, the solubility in the base oil, the effect of improving the viscosity-temperature characteristics, or the low-temperature viscometric properties may be poor, and when it falls below 10 mol %, the effect of improving the viscosity-temperature characteristics may be poor.

In this description, the comb-shaped poly(meth)acrylate means poly(meth)acrylate that is a copolymer of a monomer (M-1) represented by formula (9) and a monomer (M-2) represented by formula (10). In the comb-shaped poly(meth) acrylate, $R^{15}$ in formula (10) is a macromonomer having a number-average molecular weight (Mn) of 1,000 to 10,000 (preferably 1,500 to 8,500, more preferably 2,000 to 7,000).

[Formula 9]

(Formula 9): M-1

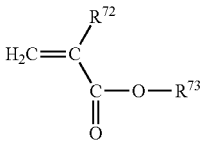

wherein $R^{72}$ represents a hydrogen atom or a methyl group, and $R^{73}$ represents a linear or branched hydrocarbon group having 6 to 18 carbon atoms.

[Formula 10]

(Formula 10): M-2

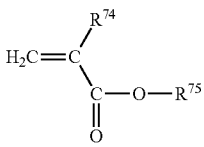

wherein $R^{74}$ represents a hydrogen atom or a methyl group, and $R^{75}$ represents a linear or branched hydrocarbon group having 19 or more carbon atoms.

As the comb-shaped poly(meth)acrylate, a macromonomer derived from the hydrogenated product of a polyolefin obtained by copolymerization of butadiene and isoprene can be employed, for example.

In the poly(meth)acrylate used in the present invention, there may be only one type of (meth)acrylate structural unit corresponding to the monomer (M-2) represented by formula (10) in the polymer or a combination of two or more types. The proportion of the structural unit corresponding to the monomer (M-2) represented by formula (10) in all monomer units of the polymer is preferably 0.5 to 70 mol %.

The viscosity index improver has a weight-average molecular weight (Mw) of, for example, 10,000 to 1,000,000, preferably 50,000 to 900,000, more preferably 100,000 to 800,000, further preferably 150,000 to 600,000.

The Mw/Mn (weight-average molecular weight/number-average molecular weight) of the viscosity index improver is, for example, 2.3 to 6.0, preferably 2.5 to 5.5, more preferably 3.0 to 5.0. When the Mw/Mn falls within such a range, good viscosity index can be maintained.

When the lubricating oil composition of the present invention contains a viscosity index improver, the content thereof can be appropriately adjusted so that the viscosity index of the lubricating oil composition is preferably 150 to 350, more preferably 170 to 290.

When a viscosity index improver is contained in the lubricating oil composition of the present invention, the content thereof is, for example, 0.1 mass % or more, preferably 1 mass % or more, based on the total amount of the composition. The upper limit is, for example, 20 mass % or less, preferably 10 mass % or less. Examples of the specific range include for example, 0.1 mass % to 20 mass %, preferably 1 mass % to 10 mass %.

In the lubricating oil composition of the present invention, the ratio of the viscosity index of the lubricating oil composition to the kinematic viscosity at 100° C. (viscosity index/kinematic viscosity at 100° C.) is preferably 29.8 or more. When the ratio of the viscosity index of the lubricating oil composition to the kinematic viscosity at 100° C. (viscosity index/kinematic viscosity at 100° C.) of the lubricating oil composition is 29.8 or more, in lubricating oil compositions that have the same winter viscosity grade and different summer viscosity grades as prescribed in SAE J300, the viscosity index increases as the addition rate of the viscosity index improver becomes higher, whereas the viscosity-temperature characteristics become better regardless of the addition rate.

In this description, the weight-average molecular weight Mw and the number-average molecular weight Mn of the viscosity index improver each mean a value determined by gel permeation chromatography (GPC) (molecular weight obtained in terms of polystyrene).

(Other Additives)

The lubricating oil composition of the present invention can contain other additives commonly used for lubricating oils depending on the purpose thereof, in order to further improve its performances. Examples of such additives can include additives such as phenolic antioxidants, phosphorus-based antioxidants, pour point depressants, and defoamers.

Examples of the phenolic ashless antioxidants can include 4,4'-methylenebis (2,6-di-t-butylphenol) or 2,6-di-t-butyl-4-methylphenol.

When the lubricating oil composition of the present invention contains a phenolic ashless antioxidant, the content thereof is generally 5.0 mass % or less, preferably 3.0 mass % or less, and is preferably 0.1 mass % or more, more preferably 0.5 mass % or more, based on the total amount of the composition.

As a phosphorus-based antioxidant, zinc dialkyldithiophosphate (ZnDTP) is preferably added. Examples of the zinc dialkyldithiophosphate can include a compound represented by formula (11) below.

[Formula 11]

Formula (11)

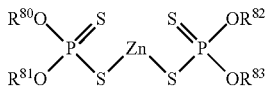

In the formula (11), $R^{80}$ to $R^{83}$ are each independently a linear or branched alkyl group having 1 to 24 carbon atoms. The alkyl group may be primary, secondary, or tertiary. As the zinc dialkyldithiophosphate, zinc dithiophosphate having a primary alkyl group (primary ZnDTP) or zinc dithiophosphate containing a secondary alkyl group (secondary ZnDTP) is preferable, in particular, one containing zinc dithiophosphate having a secondary alkyl group as a main component are preferable, for enhancing the abrasion resistance.

In the present invention, one of these zinc dialkyldithiophosphates may be used alone, or two or more of them may be used in combination.

The amount of phosphorus derived from the zinc dialkyldithiophosphate contained in the lubricating oil composition of the present invention is, for example, 400 mass ppm to 2000 mass ppm, preferably 500 mass ppm to 1000 mass, further preferably 700 mass ppm to 1000 mass ppm, based on the total amount of the composition.

(Lubricating Oil Composition for Internal Combustion Engine)

The HTHS viscosity at 150° C. of the lubricating oil composition of the present invention is, for example, 1.9 mPa·s to 3.5 mPa·s, preferably 2.0 mPa·s to 3.4 mPa·s, more preferably 2.1 mPa·s to 3.0 mPa·s. When the HTHS viscosity at 150° C. is 3.5 mPa·s or less, good fuel efficiency can be achieved. When the HTHS viscosity at 150° C. is 1.9 mPa·s or more, good lubricity can be achieved.

The HTHS viscosity at 150° C. refers to a high-temperature high-shear viscosity at 150° C. as prescribed in ASTM D 4683.

The viscosity index of the lubricating oil composition of the present invention is preferably 150 to 350, more preferably 170 to 290. When the viscosity index of the lubricating oil composition is 200 or more, the fuel efficiency can be improved, while maintaining the HTHS viscosity at 150° C. Further, when the viscosity index of the lubricating oil composition exceeds 350, evaporability may deteriorate.

In this description, the viscosity index means a viscosity index measured according to JIS K 2283-1993.

The lubricating oil composition of the present invention has a kinematic viscosity at 40° C. of preferably 20 $mm^2/s$ or more, more preferably 22 $mm^2/s$ or more, further preferably 24 $mm^2/s$ or more. The upper limit is preferably 46 $mm^2/s$ or less, more preferably 42 $mm^2/s$ or less, further preferably 40 $mm^2/s$ or less. Examples of the specific range include preferably 20 $mm^2/s$ to 46 $mm^2/s$, more preferably 22 $mm^2/s$ to 42 $mm^2/s$, further preferably 24 $mm^2/s$ to 40 $mm^2/s$. When the lubricating oil composition has a kinematic viscosity at 40° C. of 46 $mm^2/s$ or less, a sufficient fuel efficiency can be achieved. Further, when the lubricating oil composition has a kinematic viscosity at 40° C. of 20 $mm^2/s$ or more, the formation of an oil film at the lubricated location can be ensured, and the evaporation loss of the lubricating oil composition can also be reduced.

In this description, the "kinematic viscosity at 40° C." means a kinematic viscosity at 40° C. measured according to ASTM D-445.

The kinematic viscosity at 100° C. of the lubricating oil composition of the present invention is preferably 5.0 $mm^2/s$ or more, more preferably 6.0 $mm^2/s$ or more. The upper limit is preferably 12.0 $mm^2/s$ or less, more preferably 10.0 $mm^2/s$ or less. Examples of the specific range include preferably 5.0 $mm^2/s$ to 12.0 $mm^2/s$, more preferably 6.0 $mm^2/s$ to 10.0 $mm^2/s$.

(Nitrogen Management Index)

In the lubricating oil composition of the present invention, the nitrogen management index represented by formula (A) below is 0.60 or less, preferably 0.55 or less, more preferably 0.50 or less, further preferably 0.45 or less, most preferably 0.40 or less. (A): (N(B)*1.1+N(C)*1.9)/(N(D)+N(E)*1.2): wherein N(B) is an amount of nitrogen (mass ppm) derived from the molybdenum-based friction modifier based on the total amount of the composition, N(C) is an amount of nitrogen (mass ppm) derived from the nitrogen-containing ashless friction modifier based on the total amount of the composition, N(D) is an amount of nitrogen (mass ppm) derived from the succinimide or a derivative thereof based on the total amount of the composition, and N(E) is an amount of nitrogen (mass ppm) derived from the amine ashless antioxidant based on the total amount of the composition.

The content of nitrogen element in each component in the oil is measured by the chemiluminescence method according to JIS K2609.

The inventors have found that the percent increase in kinematic viscosity at 40° C. also becomes larger as the nitrogen management index increases. The nitrogen management index is an index that is useful for estimating the viscosity increase caused by deterioration due to oxidation and nitridation of lubricating oils. When the nitrogen management index is 0.60 or less, an increase in kinematic viscosity at 40° C. of the lubricating oil composition caused by deterioration due to NOx absorption can be reduced.

The content of nitrogen in the lubricating oil composition of the present invention is preferably 500 mass ppm to 2500 mass ppm, more preferably 1000 mass ppm to 2000 mass ppm, based on the total amount of the composition.

In this description, the amount of sulfated ash means an amount of sulfated ash measured according to ASTM D874. In the lubricating oil composition for an internal combustion engine, the amount of sulfated ash becomes larger as the amount of metals increases. As the amount of sulfated ash becomes larger, the lifetime of a filter is shortened. Accordingly, the amount of sulfated ash is preferably decreased. In the present invention, the amount of sulfated ash is 0.9 mass % or less, more preferably 0.8 mass % or less.

EXAMPLES

The present invention will be described below by way of examples. The present invention is not limited to the following embodiments.

<Formulation of Lubricating Oil>

Base oils and additives were mixed at compounding ratios shown in Tables 1 to 4, to prepare test lubricating oil compositions for Examples and Comparative Examples. The test lubricating oil compositions obtained were subjected to the following evaluations. The evaluation results are shown in Tables 5 to 8.

(A) Lubricant Base Oil

- Lubricant base oil 1: Group III base oil (hydrocracked mineral base oil), kinematic viscosity: 4.2 $mm^2/s$ (100° C.), 19.4 $mm^2/s$ (40° C.)
- Lubricant base oil 2: Group II base oil (hydrocracked mineral base oil), kinematic viscosity: 3.0 $mm^2/s$ (100° C.), 12.6 $mm^2/s$ (40° C.)
- Lubricant base oil 3: Poly-α-olefin, kinematic viscosity: 3.9 $mm^2/s$ (100° C.), 17.4 $mm^2/s$ (40° C.)

Lubricant base oils were mixed at mass ratios shown in Tables 1 to 4, to prepare lubricant base oils. In the tables, the numerical value of the lubricant base oil represents the mass ratio based on the total amount of the lubricant base oil.

Additives were added as described in Tables 1 to 4. Details of the additives are as follows. The amounts of additives mixed are based on the total amount of the composition.

(B) Molybdenum-Based Friction Modifier

- Molybdenum-based friction modifier 1: Molybdate dialkylamine salt (molybdenum content of 10.0 mass %, nitrogen content of 1.2 mass %)
- Molybdenum-based friction modifier 2: Molybdenum dithiocarbamate (molybdenum content of 10.1 mass %, nitrogen content of 1.5 mass %)

(C) Nitrogen-Containing Ashless Friction Modifier

- Ashless friction modifier 1: N-Oleoyl sarcosine ((Z)—N methyl-N-(1-oxo-9-octadecynyl)glycine), nitrogen content of 3.78 mass %
- Ashless friction modifier 2: (9Z)-9-Octadecene amide, nitrogen content of 3.00 mass %
- Ashless friction modifier 3: Octadecenyl urea, nitrogen content of 9.03 mass %
- Ashless friction modifier 4: (Z)-9-Octadecene-1-amine, nitrogen content of 5.24 mass %
- Ashless friction modifier 5: 2,2'-(Octadecane-1-ylimino) diethanol, nitrogen content of 4.05 mass %

(D) Succinimide or Derivative Thereof

- Dispersant 1: Succinimide-based dispersant (boron content of 0.5 mass %, nitrogen content of 1.5 mass %)
- Dispersant 2: Succinimide-based dispersant (boron content of 0.0 mass %, nitrogen content of 1.5 mass %)

(E) Amine Antioxidant

- Amine ashless antioxidant 1: Bis(nonane-1-yl phenyl) amine, nitrogen content of 3.6%

Other Antioxidants

- Phenolic ashless antioxidant 1: Benzenepropanoic acid, 3,5-bis(1,1-dimethyl ethyl)-4-hydroxy-, C7-C9 side chain alkyl ester
- Phosphorus-based antioxidant 1: Zinc dialkyldithiophosphate, zinc content of 9.3 mass %, phosphorus content of 8.5 mass %, sulfur content: 17.8 mass %, secondary ZnDTP
- Phosphorus-based antioxidant 2: Zinc dialkyldithiophosphate, zinc content of 7.8 mass %, phosphorus content of 7.0 mass %, sulfur content: 14.8 mass %, primary ZnDTP (F) Metallic Detergent

- Metallic detergent 1: Calcium carbonate salicylate (calcium content of 8.0 mass %, base number: 230 mgKOH/g)
- Metallic detergent 2: Magnesium carbonate salicylate (magnesium content of 7.5 mass %, base number: 350 mgKOH/g)

Metallic detergent 3: Magnesium carbonate sulfonate (magnesium content of 9.1 mass %, base number: 400 mgKOH/g)

(G) Viscosity Index Improver

Viscosity index improver 1: Comb-shaped poly(meth) acrylate (weight-average molecular weight Mw: 490,000, Mw/Mn: 4.0)

Viscosity index improver 2: Comb-shaped poly(meth) acrylate (weight-average molecular weight Mw: 430,000, Mw/Mn: 5.2)

Viscosity index improver 3: Linear poly(meth)acrylate (weight-average molecular weight Mw: 460,000, Mw/Mn: 2.9)

Viscosity index improver 4: Linear poly(meth)acrylate (weight-average molecular weight Mw: 480,000, Mw/Mn: 2.8)

Viscosity index improver 5: Linear poly(meth)acrylate (weight-average molecular weight Mw: 440,000, Mw/Mn: 2.3)

Viscosity index improver 6: Dispersed poly(meth)acrylate (weight-average molecular weight Mw: 270,000, Mw/Mn: 3.8)

Viscosity index improver 7: Olefin copolymer (weight-average molecular weight Mw: 180,000, Mw/Mn: 1.5)

<Evaluation Method>

(1) Amount of Sulfated Ash

The amount of sulfated ash was measured according to ASTM D874.

(2) HTHS Viscosity and Viscosity Index

The HTHS viscosity at 150° C. was measured according to ASTM D 4683.

Further, the viscosity index was measured according to JIS K 2283-2000.

(3) Acid Value

The acid value was measured according to JIS K2501:2003.

(4) NOx Injection Test (4-1) Preparation of Each NOx Degraded Oil 150 g of each lubricating oil composition was put into a 200 mL four-necked flask and heated in an oil bath at 155° C. Simultaneously with heating, the air (with a flow rate of 115 ml/min) and NO gas diluted with nitrogen (NO concentration: 8000 volume ppm) (with a flow rate of 20 ml/min) (which will be hereinafter referred to as mixed gas) were continuously introduced into the lubricating oil composition for 32 hours or 48 hours, to obtain an NOx degraded oil.

(4-2) Measurement of Acid Value of Each NOx Degraded Oil

The acid value of each NOx degraded oil obtained by the aforementioned method was measured according to JIS K2501:2003. The acid value of each lubricating oil composition was compared with that before NOx injection. For NOx degraded oils after a lapse of 32 hours, those with an increase in acid value of 2.7 mgKOH/g or less were evaluated to have good oxidative stability. Among NOx degraded oils after a lapse of 48 hours, those with an increase in acid value of 3.8 mgKOH/g or less were evaluated to have good oxidative stability.

(4-3) Measurement of Kinematic Viscosity at 40° C. of Each NOx Degraded Oil

The kinematic viscosity at 40° C. of each NOx degraded oil obtained by the aforementioned method was measured according to ASTM D-445. The kinematic viscosity at 40° C. of each lubricating oil composition was compared with that before NOx injection. Among NOx degraded oils after a lapse of 32 hours or 48 hours, those with a 9% or less increase in kinematic viscosity at 40° C. were evaluated to have good oxidative stability.

(5) SRV Test (Evaluation of Friction Coefficient)

An SRV tester, available from OPTIMOL, was used for measuring the friction coefficient. The test pieces used were cylindrical standard test pieces (diameter 15×22 mm) and disk-shaped standard test pieces (diameter 24×6.9 mm) according to ASTM D5706, D5707, and D6425. The test conditions employed were: a load of 50 N, an oscillation frequency of 50 Hz, an amplitude of 1.5 mm, a test time of 15 minutes, and a test temperature of 80° C. or 100° C. Each friction coefficient employed was an average of values measured in test times of 10 to 15 minutes. Test pieces with a friction coefficient of 0.062 or less at a test temperature of 80° C. and those with a friction coefficient of 0.062 or less at a test temperature of 100° C. were evaluated to have good fuel efficiency.

The evaluation results for each test lubricating oil composition are shown in Tables 5 to 8.

TABLE 1

| | | | Example 1 | Example 2 | Example 3 | Example 4 | Example 5 | Example 6 | Example 7 | Example 8 |
|---|---|---|---|---|---|---|---|---|---|---|
| (A) Lubricant base oil | Base oil 1 | mass % | 100 | 100 | 100 | 100 | 100 | 100 | 100 | 100 |
| | Base oil 2 | mass % | | | | | | | | |
| | Base oil 3 | mass % | | | | | | | | |
| | Kinematic viscosity at 100° C. | mm2/s | 4.2 | 4.2 | 4.2 | 4.2 | 4.2 | 4.2 | 4.2 | 4.2 |
| (G) Viscosity index improver | Viscosity index improver 1 | mass % | 6.4 | 6.4 | 6.4 | | | | | 4.6 |
| | Viscosity index improver 2 | mass % | | | | 7.3 | | | | |
| | Viscosity index improver 3 | mass % | | | | | 8.2 | | | |
| | Viscosity index improver 4 | mass % | | | | | | 9.9 | | |
| | Viscosity index improver 5 | mass % | | | | | | | 6.0 | |
| | Viscosity index improver 6 | mass % | | | | | | | | 1.0 |
| | Viscosity index improver 7 | mass % | | | | | | | | |
| (F) Metallic detergent | Metallic detergent 1 | mass % | 1.88 | 1.88 | 1.88 | 1.88 | 1.88 | 1.88 | 1.88 | 1.88 |
| | Metallic detergent 2 | mass % | 0.40 | 0.40 | 0.40 | 0.40 | 0.40 | 0.40 | 0.40 | 0.40 |
| | Metallic detergent 3 | mass % | | | | | | | | |

TABLE 1-continued

| | | | Example 1 | Example 2 | Example 3 | Example 4 | Example 5 | Example 6 | Example 7 | Example 8 |
|---|---|---|---|---|---|---|---|---|---|---|
| (D) Succinimide | Dispersant 1 | mass % | | | | | | | | |
| | Dispersant 2 | mass % | 2.8 | 2.8 | 2.8 | 2.8 | 2.8 | 2.8 | 2.8 | 2.8 |
| (E) Antioxidant | Amine 1 | mass % | 1.4 | 1.7 | 1.7 | 1.4 | 1.4 | 1.4 | 1.4 | 1.4 |
| Other antioxidants | Phenolic 1 | mass % | 0.5 | 0.5 | 0.5 | 0.5 | 0.5 | 0.5 | 0.5 | 0.5 |
| | Phosphorus-based 1 | mass % | 0.25 | 0.25 | 0.25 | 0.25 | 0.25 | 0.25 | 0.25 | 0.25 |
| | Phosphorus-based 2 | mass % | 0.77 | 0.77 | 0.77 | 0.77 | 0.77 | 0.77 | 0.77 | 0.77 |
| (B) Molybdenum-based friction modifier | Friction modifier 1 | mass % | | | | | | | | |
| | Friction modifier 2 | mass % | 0.7 | 0.7 | 0.7 | 0.7 | 0.7 | 0.7 | 0.7 | 0.7 |
| (C) Ashless friction modifier | Ashless friction modifier 1 | mass % | 0.4 | 0.4 | 0.8 | 0.4 | 0.4 | 0.4 | 0.4 | 0.4 |
| | Ashless friction modifier 2 | mass % | | | | | | | | |
| | Ashless friction modifier 3 | mass % | | | | | | | | |
| | Ashless friction modifier 4 | mass % | | | | | | | | |
| | Ashless friction modifier 5 | mass % | | | | | | | | |

25

TABLE 2

| | | | Example 9 | Example 10 | Example 11 | Example 12 | Example 13 | Example 14 | Example 15 | Example 16 |
|---|---|---|---|---|---|---|---|---|---|---|
| (A) Lubricant base oil | Base oil 1 | mass % | 100 | 100 | 100 | 100 | 100 | 100 | 90 | 80 |
| | Base oil 2 | mass % | | | | | | | 10 | 20 |
| | Base oil 3 | mass % | | | | | | | | |
| | Kinematic viscosity at 100° C. | mm2/s | 4.2 | 4.2 | 4.2 | 4.2 | 4.2 | 4.2 | 4.1 | 3.9 |
| (G) Viscosity index improver | Viscosity index improver 1 | mass % | 7.6 | 6.4 | 6.4 | 6.4 | 6.4 | 6.4 | 6.4 | 6.4 |
| | Viscosity index improver 2 | mass % | | | | | | | | |
| | Viscosity index improver 3 | mass % | | | | | | | | |
| | Viscosity index improver 4 | mass % | | | | | | | | |
| | Viscosity index improver 5 | mass % | | | | | | | | |
| | Viscosity index improver 6 | mass % | | | | | | | | |
| | Viscosity index improver 7 | mass % | | | | | | | | |
| (F) Metallic detergent | Metallic detergent 1 | mass % | 1.88 | 1.88 | 1.88 | 1.88 | 2.17 | 1.25 | 1.88 | 1.88 |
| | Metallic detergent 2 | mass % | 0.40 | 0.40 | 0.40 | 0.40 | 0.14 | 0.93 | 0.40 | 0.40 |
| | Metallic detergent 3 | mass % | | | | | | | | |
| (D) Succinimide | Dispersant 1 | mass % | | | | | | | | |
| | Dispersant 2 | mass % | 2.8 | 2.8 | 2.8 | 2.8 | 2.8 | 2.8 | 2.8 | 2.8 |
| (E) Antioxidant | Amine 1 | mass % | 1.4 | 1.4 | 1.4 | 1.4 | 1.4 | 1.4 | 1.4 | 1.4 |
| Other antioxidants | Phenolic 1 | mass % | 0.5 | 0.5 | 0.5 | 0.5 | 0.5 | 0.5 | 0.5 | 0.5 |
| | Phosphorus-based 1 | mass % | 0.25 | 0.25 | 0.25 | 0.25 | 0.25 | 0.25 | 0.25 | 0.25 |
| | Phosphorus-based 2 | mass % | 0.77 | 0.77 | 0.77 | 0.77 | 0.77 | 0.77 | 0.77 | 0.77 |
| (B) Molybdenum-based friction modifier | Friction modifier 1 | mass % | | | | | | | | |
| | Friction modifier 2 | mass % | 0.7 | 0.7 | 0.7 | 0.7 | 0.7 | 0.7 | 0.7 | 0.7 |
| (C) Ashless friction modifier | Ashless friction modifier 1 | mass % | | | | | 0.40 | 0.40 | 0.40 | 0.40 |
| | Ashless friction modifier 2 | mass % | | | | 0.51 | | | | |
| | Ashless friction modifier 3 | mass % | | | 0.17 | | | | | |
| | Ashless friction modifier 4 | mass % | 0.28 | | | | | | | |

TABLE 2-continued

| | | | Example 9 | Example 10 | Example 11 | Example 12 | Example 13 | Example 14 | Example 15 | Example 16 |
|---|---|---|---|---|---|---|---|---|---|---|
| | Ashless friction modifier 5 | mass % | | 0.38 | | | | | | |

TABLE 3

| | | | Example 17 | Example 18 | Example 19 | Example 20 | Example 21 | Example 22 | Example 23 | Example 24 |
|---|---|---|---|---|---|---|---|---|---|---|
| (A) Lubricant base oil | Base oil 1 | mass % | 100 | 100 | | 92 | 92 | 92 | 92 | 92 |
| | Base oil 2 | mass % | | | | 8 | 8 | 8 | 8 | 8 |
| | Base oil 3 | mass % | | | 100 | | | | | |
| | Kinematic viscosity at 100° C. | mm2/s | 4.2 | 4.2 | 3.9 | 4.1 | 4.1 | 4.1 | 4.1 | 4.1 |
| (G) Viscosity index improver | Viscosity index improver 1 | mass % | 0.8 | 10 | 4.6 | 6.0 | 4.6 | 7.2 | 8.1 | 3.5 |
| | Viscosity index improver 2 | mass % | | | | | | | | |
| | Viscosity index improver 3 | mass % | | | | | | | | |
| | Viscosity index improver 4 | mass % | | | | | | | | |
| | Viscosity index improver 5 | mass % | | | | | | | | |
| | Viscosity index improver 6 | mass % | | | | | | | | |
| | Viscosity index improver 7 | mass % | | | | | | | | |
| (F) Metallic detergent | Metallic detergent 1 | mass % | 1.88 | 1.88 | 1.88 | 2.17 | 2.17 | 2.17 | 2.17 | 2.17 |
| | Metallic detergent 2 | mass % | 0.40 | 0.40 | 0.40 | | | | | |
| | Metallic detergent 3 | mass % | | | | 0.11 | 0.11 | 0.11 | 0.11 | 0.11 |
| (D) Succinimide | Dispersant 1 | mass % | | | | | | | | 4.9 |
| | Dispersant 2 | mass % | 2.8 | 2.8 | 2.8 | 3.8 | 5.1 | 2.6 | 2.6 | |
| (E) Antioxidant | Amine 1 | mass % | 1.4 | 1.4 | 1.4 | 1.7 | 1.7 | 2.55 | 2.8 | 2.55 |
| Other antioxidants | Phenolic 1 | mass % | 0.5 | 0.5 | 0.5 | | | | | |
| | Phosphorus-based 1 | mass % | 0.25 | 0.25 | 0.25 | 0.55 | 0.55 | 0.55 | 0.55 | 0.55 |
| | Phosphorus-based 2 | mass % | 0.77 | 0.77 | 0.77 | 0.42 | 0.42 | 0.42 | 0.42 | 0.42 |
| (B) Molybdenum-based friction modifier | Friction modifier 1 | mass % | | | | 0.15 | 0.15 | 0.15 | 0.15 | 0.15 |
| | Friction modifier 2 | mass % | 0.7 | 0.7 | 0.7 | 0.7 | 0.7 | 0.7 | 0.7 | 0.7 |
| (C) Ashless friction modifier | Ashless friction modifier 1 | mass % | 0.40 | 0.40 | 0.40 | 0.50 | 0.50 | 0.50 | 0.50 | 0.50 |
| | Ashless friction modifier 2 | mass % | | | | | | | | |
| | Ashless friction modifier 3 | mass % | | | | | | | | |
| | Ashless friction modifier 4 | mass % | | | | | | | | |
| | Ashless friction modifier 5 | mass % | | | | | | | | |

TABLE 4

| | | | Example 25 | Comparative Example 1 | Comparative Example 2 | Comparative Example 3 | Comparative Example 4 | Comparative Example 5 | Comparative Example 6 | Comparative Example 7 |
|---|---|---|---|---|---|---|---|---|---|---|
| (A) Lubricant base oil | Base oil 1 | mass % | 100 | 100 | 100 | 100 | 100 | 92 | 92 | 100 |
| | Base oil 2 | mass % | | | | | | 8 | 8 | |
| | Base oil 3 | mass % | | | | | | | | |
| | Kinematic viscosity at 100° C. | mm2/s | 4.2 | 4.2 | 4.2 | 4.2 | 4.2 | 4.1 | 4.1 | 4.2 |
| (G) Viscosity index | Viscosity index improver 1 | mass % | | 6.9 | 9.1 | 6.4 | 7.4 | 7.3 | 7.3 | 7.3 |

TABLE 4-continued

| | | | Example 25 | Comparative Example 1 | Comparative Example 2 | Comparative Example 3 | Comparative Example 4 | Comparative Example 5 | Comparative Example 6 | Comparative Example 7 |
|---|---|---|---|---|---|---|---|---|---|---|
| improver | Viscosity index improver 2 | mass % | | | | | | | | |
| | Viscosity index improver 3 | mass % | | | | | | | | |
| | Viscosity index improver 4 | mass % | | | | | | | | |
| | Viscosity index improver 5 | mass % | | | | | | | | |
| | Viscosity index improver 6 | mass % | | | | | | | | |
| | Viscosity index improver 7 | mass % | 5.3 | | | | | | | |
| (F) Metallic detergent | Metallic detergent 1 | mass % | 1.88 | 1.88 | 1.88 | 1.88 | 1.88 | 2.17 | 2.17 | 1.88 |
| | Metallic detergent 2 | mass % | 0.40 | 0.40 | 0.40 | 0.40 | 0.93 | | | 0.40 |
| | Metallic detergent 3 | mass % | | | | | | 0.11 | 0.11 | |
| (D) Succinimide | Dispersant 1 | mass % | | | | | | | | |
| | Dispersant 2 | mass % | 2.8 | 2.8 | 0.4 | 2.8 | 2.8 | 2.2 | 2.6 | 2.8 |
| (E) Antioxidant | Amine 1 | mass % | 1.4 | 0.2 | 1.2 | 1.7 | 1.4 | 1.1 | 0.95 | 1.4 |
| Other antioxidants | Phenolic 1 | mass % | 0.5 | 0.5 | 0.5 | 0.5 | 0.5 | | | 0.5 |
| | Phosphorus-based 1 | mass % | 0.25 | 0.25 | 0.25 | 0.25 | 0.25 | 0.55 | 0.55 | 0.25 |
| | Phosphorus-based 2 | mass % | 0.77 | 0.77 | 0.77 | 0.77 | 0.77 | 0.42 | 0.42 | 0.77 |
| (B) Molybdenum-based friction modifier | Friction modifier 1 | mass % | | | | | | 0.15 | 0.15 | |
| | Friction modifier 2 | mass % | 0.7 | 0.7 | 0.7 | 0.7 | 0.7 | 0.7 | 0.7 | 0.7 |
| (C) Ashless friction modifier | Ashless friction modifier 1 | mass % | 0.40 | 0.40 | 0.40 | 1.2 | 0.40 | 0.50 | 0.50 | |
| | Ashless friction modifier 2 | mass % | | | | | | | | |
| | Ashless friction modifier 3 | mass % | | | | | | | | |
| | Ashless friction modifier 4 | mass % | | | | | | | | |
| | Ashless friction modifier 5 | mass % | | | | | | | | |

TABLE 5

| | | | Example 1 | Example 2 | Example 3 | Example 4 | Example 5 | Example 6 | Example 7 | Example 8 |
|---|---|---|---|---|---|---|---|---|---|---|
| Element amount | Ca amount | mass ppm | 1504 | 1504 | 1504 | 1504 | 1504 | 1504 | 1504 | 1504 |
| | Mg amount | mass ppm | 300 | 300 | 300 | 300 | 300 | 300 | 300 | 300 |
| | Mo amount | mass ppm | 700 | 700 | 700 | 700 | 700 | 700 | 700 | 700 |
| | P amount | mass ppm | 752 | 752 | 752 | 752 | 752 | 752 | 752 | 752 |
| | Zn amount | mass ppm | 833 | 833 | 833 | 833 | 833 | 833 | 833 | 833 |
| | B amount | mass ppm | 0 | 0 | 0 | 0 | 0 | 0 | 0 | 0 |
| N amount | Total value | mass % | 0.118 | 0.129 | 0.144 | 0.118 | 0.118 | 0.118 | 0.118 | 0.118 |
| | Nitrogen management index | | 0.39 | 0.35 | 0.60 | 0.39 | 0.39 | 0.39 | 0.39 | 0.39 |
| | (B)-derived | mass % | 0.011 | 0.011 | 0.011 | 0.011 | 0.011 | 0.011 | 0.011 | 0.011 |
| | (C)-derived | mass % | 0.015 | 0.015 | 0.030 | 0.015 | 0.015 | 0.015 | 0.015 | 0.015 |
| | (D)-derived | mass % | 0.042 | 0.042 | 0.042 | 0.042 | 0.042 | 0.042 | 0.042 | 0.042 |
| | (E)-derived | mass % | 0.050 | 0.061 | 0.061 | 0.050 | 0.050 | 0.050 | 0.050 | 0.050 |
| Sulfated ash content | | mass % | 0.8 | 0.8 | 0.8 | 0.8 | 0.8 | 0.8 | 0.8 | 0.8 |
| Kinematic viscosity | 40° C. | mm2/s | 26.64 | 26.76 | 26.72 | 26.82 | 27.15 | 29.90 | 29.75 | 27.83 |
| | 100° C. | mm2/s | 6.57 | 6.74 | 6.58 | 6.64 | 6.66 | 7.05 | 6.95 | 6.55 |
| Viscosity index | | | 218 | 217 | 218 | 221 | 218 | 211 | 207 | 203 |
| HTHS viscosity | 150° C. | mPa · s | 2.3 | 2.3 | 2.3 | 2.3 | 2.3 | 2.3 | 2.3 | 2.3 |
| Acid value | Initial stage | mgKOH/g | 2.3 | 2.3 | 2.4 | 2.4 | 2.3 | 2.2 | 2.3 | 2.2 |
| NOx injection test (at 155° C., for 32 hours) | Kinematic viscosity (at 40° C.) | mm2/s | 27.71 | 27.91 | 27.91 | 27.87 | 28.04 | 29.70 | 29.80 | 28.82 |
| | Percent increase in kinematic viscosity (at 40° C.) | % | 4.0 | 4.3 | 4.5 | 3.9 | 3.3 | -0.7 | 0.2 | 3.6 |
| | Acid value | mgKOH/g | 4.5 | 4.8 | 4.9 | 4.6 | 4.6 | 4.5 | 4.6 | 4.4 |
| | Increase in acid value | mgKOH/g | 2.3 | 2.5 | 2.5 | 2.2 | 2.3 | 2.2 | 2.3 | 2.2 |
| NOx injection test (at 155° C., | Kinematic viscosity (at 40° C.) | mm2/s | 28.15 | 28.05 | 29.25 | 28.51 | 28.62 | 30.50 | 30.60 | 29.61 |

TABLE 5-continued

| | | | Example 1 | Example 2 | Example 3 | Example 4 | Example 5 | Example 6 | Example 7 | Example 8 |
|---|---|---|---|---|---|---|---|---|---|---|
| for 48 hours) | Percent increase in kinematic viscosity (at 40° C.) | % | 5.7 | 4.8 | 9.5 | 6.3 | 5.4 | 2.0 | 2.9 | 6.4 |
| | Acid value | mgKOH/g | 5.7 | 5.3 | 6.2 | 5.8 | 5.8 | 5.9 | 6.0 | 5.9 |
| | Increase in acid value | mgKOH/g | 3.4 | 3.0 | 3.8 | 3.4 | 3.5 | 3.6 | 3.7 | 3.7 |
| Friction coefficient (SRV, 50N) | 80° C. | | 0.057 | 0.058 | 0.058 | 0.057 | 0.058 | 0.057 | 0.058 | 0.059 |
| | 100° C. | | 0.057 | 0.057 | 0.057 | 0.057 | 0.058 | 0.059 | 0.058 | 0.058 |

TABLE 6

| | | | Example 9 | Example 10 | Example 11 | Example 12 | Example 13 | Example 14 | Example 15 | Example 16 |
|---|---|---|---|---|---|---|---|---|---|---|
| Element amount | Ca amount | mass ppm | 1504 | 1504 | 1504 | 1504 | 1736 | 1000 | 1504 | 1504 |
| | Mg amount | mass ppm | 300 | 300 | 300 | 300 | 105 | 698 | 300 | 300 |
| | Mo amount | mass ppm | 700 | 700 | 700 | 700 | 700 | 700 | 700 | 700 |
| | P amount | mass ppm | 752 | 752 | 752 | 752 | 752 | 752 | 752 | 752 |
| | Zn amount | mass ppm | 833 | 833 | 833 | 833 | 833 | 833 | 833 | 833 |
| | B amount | mass ppm | 0 | 0 | 0 | 0 | 0 | 0 | 0 | 0 |
| N amount | Total value | mass % | 0.118 | 0.118 | 0.118 | 0.118 | 0.118 | 0.118 | 0.118 | 0.118 |
| | Nitrogen management index | | 0.38 | 0.40 | 0.40 | 0.40 | 0.39 | 0.39 | 0.39 | 0.39 |
| | (B)-derived | mass % | 0.011 | 0.011 | 0.011 | 0.011 | 0.011 | 0.011 | 0.011 | 0.011 |
| | (C)-derived | mass % | 0.015 | 0.015 | 0.015 | 0.015 | 0.015 | 0.015 | 0.015 | 0.015 |
| | (D)-derived | mass % | 0.042 | 0.042 | 0.042 | 0.042 | 0.042 | 0.042 | 0.042 | 0.042 |
| | (E)-derived | mass % | 0.050 | 0.050 | 0.050 | 0.050 | 0.050 | 0.050 | 0.050 | 0.050 |
| Sulfated ash content | | mass % | 0.8 | 0.8 | 0.8 | 0.8 | 0.8 | 0.8 | 0.8 | 0.8 |
| Kinematic viscosity | 40° C. | mm2/s | 26.55 | 26.64 | 26.58 | 26.44 | 26.55 | 26.35 | 25.76 | 25.09 |
| | 100° C. | mm2/s | 6.62 | 6.53 | 6.49 | 6.55 | 6.57 | 6.45 | 6.52 | 6.55 |
| Viscosity index | | | 222 | 215 | 214 | 219 | 219 | 206 | 225 | 236 |
| HTHS viscosity | 150° C. | mPa · s | 2.3 | 2.3 | 2.3 | 2.3 | 2.3 | 2.3 | 2.3 | 2.3 |
| Acid value | Initial stage | mgKOH/g | 2.2 | 2.0 | 2.1 | 1.9 | 2.2 | 2.3 | 2.3 | 2.5 |
| NOx injection test (at 155° C., for 32 hours) | Kinematic viscosity (at 40° C.) | mm2/s | 27.25 | 27.22 | 27.11 | 25.83 | 26.40 | 26.20 | 26.30 | 26.10 |
| | Percent increase in kinematic viscosity (at 40° C.) | % | 2.6 | 2.2 | 2.0 | -2.3 | -0.6 | -0.6 | 2.1 | 4.0 |
| | Acid value | mgKOH/g | 4.8 | 4.2 | 3.9 | 4.4 | 4.2 | 4.7 | 4.8 | 4.8 |
| | Increase in acid value | mgKOH/g | 2.6 | 2.1 | 1.8 | 2.5 | 2.0 | 2.4 | 2.5 | 2.4 |
| NOx injection test (at 155° C., for 48 hours) | Kinematic viscosity (at 40° C.) | mm2/s | 27.95 | 27.91 | 27.68 | 26.58 | 26.80 | 27.09 | 27.41 | 27.03 |
| | Percent increase in kinematic viscosity (at 40° C.) | % | 5.3 | 4.8 | 4.1 | 0.5 | 0.9 | 2.8 | 6.4 | 7.7 |
| | Acid value | mgKOH/g | 6.0 | 5.4 | 5.2 | 5.7 | 5.9 | 6.0 | 6.0 | 6.2 |
| | Increase in acid value | mgKOH/g | 3.8 | 3.4 | 3.1 | 3.8 | 3.6 | 3.8 | 3.7 | 3.8 |
| Friction coefficient (SRV, 50N) | 80° C. | | 0.062 | 0.054 | 0.058 | 0.061 | 0.054 | 0.059 | 0.059 | 0.058 |
| | 100° C. | | 0.061 | 0.059 | 0.058 | 0.060 | 0.054 | 0.052 | 0.059 | 0.057 |

TABLE 7

| | | | Example 17 | Example 18 | Example 19 | Example 20 | Example 21 | Example 22 | Example 23 | Example 24 |
|---|---|---|---|---|---|---|---|---|---|---|
| Element amount | Ca amount | mass ppm | 1504 | 1504 | 1504 | 1736 | 1736 | 1736 | 1736 | 1736 |
| | Mg amount | mass ppm | 300 | 300 | 300 | 100 | 100 | 100 | 100 | 100 |
| | Mo amount | mass ppm | 700 | 700 | 700 | 850 | 850 | 850 | 850 | 850 |
| | P amount | mass ppm | 752 | 752 | 752 | 762 | 762 | 762 | 762 | 762 |
| | Zn amount | mass ppm | 833 | 833 | 833 | 839 | 839 | 839 | 839 | 839 |
| | B amount | mass ppm | 0 | 0 | 0 | 0 | 0 | 0 | 0 | 245 |
| N amount | Total value | mass % | 0.118 | 0.118 | 0.118 | 0.149 | 0.169 | 0.162 | 0.171 | 0.197 |
| | Nitrogen management index | | 0.39 | 0.39 | 0.39 | 0.38 | 0.33 | 0.33 | 0.31 | 0.27 |

TABLE 7-continued

| | | | Example 17 | Example 18 | Example 19 | Example 20 | Example 21 | Example 22 | Example 23 | Example 24 |
|---|---|---|---|---|---|---|---|---|---|---|
| | (B)-derived | mass % | 0.011 | 0.011 | 0.011 | 0.012 | 0.012 | 0.012 | 0.012 | 0.012 |
| | (C)-derived | mass % | 0.015 | 0.015 | 0.015 | 0.019 | 0.019 | 0.019 | 0.019 | 0.019 |
| | (D)-derived | mass % | 0.042 | 0.042 | 0.042 | 0.057 | 0.077 | 0.039 | 0.039 | 0.074 |
| | (E)-derived | mass % | 0.050 | 0.050 | 0.050 | 0.061 | 0.061 | 0.092 | 0.101 | 0.092 |
| Sulfated ash content | | mass % | 0.8 | 0.8 | 0.8 | 0.8 | 0.8 | 0.8 | 0.8 | 0.8 |
| Kinematic viscosity | 40° C. | mm2/s | 23.77 | 28.58 | 23.77 | 26.57 | 27.65 | 25.65 | 26.39 | 26.64 |
| | 100° C. | mm2/s | 5.17 | 7.45 | 5.26 | 6.41 | 6.32 | 6.59 | 6.79 | 6.28 |
| Viscosity index | | | 155 | 247 | 162 | 208 | 191 | 223 | 235 | 200 |
| HTHS viscosity | 150° C. | mPa · s | 1.9 | 2.6 | 1.9 | 2.3 | 2.3 | 2.3 | 2.3 | 2.3 |
| Acid value | Initial stage | mgKOH/g | 2.3 | 2.3 | 2.6 | 2.2 | 2.0 | 2.3 | 2.4 | 2.6 |
| NOx injection test (at 155° C., for 32 hours) | Kinematic viscosity (at 40° C.) | mm2/s | 25.10 | 29.13 | 25.01 | 27.81 | 28.82 | 26.76 | 27.68 | 28.18 |
| | Percent increase in kinematic viscosity (at 40° C.) | % | 5.6 | 1.9 | 5.2 | 4.7 | 4.2 | 4.3 | 4.9 | 5.8 |
| | Acid value | mgKOH/g | 4.6 | 4.5 | 4.6 | 4.2 | 4.2 | 4.1 | 4.2 | 5.0 |
| | Increase in acid value | mgKOH/g | 2.3 | 2.2 | 2.0 | 2.0 | 2.2 | 1.8 | 1.7 | 2.3 |
| NOx injection test (at 155° C., for 48 hours) | Kinematic viscosity (at 40° C.) | mm2/s | 25.80 | 30.01 | 25.70 | 28.63 | 29.53 | 27.95 | 28.55 | 28.97 |
| | Percent increase in kinematic viscosity (at 40° C.) | % | 8.5 | 5.0 | 8.1 | 7.8 | 6.8 | 9.0 | 8.2 | 8.7 |
| | Acid value | mgKOH/g | 6.0 | 5.8 | 6.1 | 5.2 | 5.3 | 5.2 | 5.2 | 5.2 |
| | Increase in acid value | mgKOH/g | 3.7 | 3.5 | 3.6 | 3.0 | 3.3 | 2.9 | 2.7 | 2.6 |
| Friction coefficient (SRV, 50N) | 80° C. | | 0.058 | 0.056 | 0.059 | 0.059 | 0.054 | 0.054 | 0.055 | 0.059 |
| | 100° C. | | 0.056 | 0.059 | 0.056 | 0.053 | 0.054 | 0.053 | 0.054 | 0.058 |

TABLE 8

| | | | Example 25 | Comparative Example 1 | Comparative Example 2 | Comparative Example 3 | Comparative Example 4 | Comparative Example 5 | Comparative Example 6 | Comparative Example 7 |
|---|---|---|---|---|---|---|---|---|---|---|
| Element amount | Ca amount | mass ppm | 1504 | 1504 | 1504 | 1504 | 1504 | 1736 | 1736 | 1504 |
| | Mg amount | mass ppm | 300 | 300 | 300 | 300 | 698 | 100 | 100 | 300 |
| | Mo amount | mass ppm | 700 | 700 | 700 | 700 | 700 | 850 | 850 | 700 |
| | P amount | mass ppm | 752 | 752 | 752 | 752 | 752 | 762 | 762 | 752 |
| | Zn amount | mass ppm | 833 | 833 | 833 | 833 | 833 | 839 | 839 | 833 |
| | B amount | mass ppm | 0 | 0 | 0 | 0 | 0 | 0 | 0 | 0 |
| N amount | Total value | mass % | 0.118 | 0.075 | 0.075 | 0.159 | 0.118 | 0.104 | 0.104 | 0.103 |
| | Nitrogen management index | | 0.39 | 0.80 | 0.70 | 0.85 | 0.39 | 0.61 | 0.62 | 0.11 |
| | (B)-derived | mass % | 0.011 | 0.011 | 0.011 | 0.011 | 0.011 | 0.012 | 0.012 | 0.011 |
| | (C)-derived | mass % | 0.015 | 0.015 | 0.015 | 0.045 | 0.015 | 0.019 | 0.019 | 0.000 |
| | (D)-derived | mass % | 0.042 | 0.042 | 0.006 | 0.042 | 0.042 | 0.033 | 0.039 | 0.042 |
| | (E)-derived | mass % | 0.050 | 0.007 | 0.043 | 0.061 | 0.050 | 0.040 | 0.034 | 0.050 |
| Sulfated ash content | | mass % | 0.8 | 0.8 | 0.8 | 0.8 | 1.0 | 0.8 | 0.8 | 0.8 |
| Kinematic viscosity | 40° C. | mm2/s | 35.88 | 26.40 | 23.98 | 27.11 | 26.57 | 25.28 | 25.53 | 26.37 |
| | 100° C. | mm2/s | 7.22 | 6.57 | 6.42 | 6.59 | 6.55 | 6.39 | 6.43 | 6.51 |
| Viscosity index | | | 170 | 221 | 243 | 214 | 217 | 223 | 222 | 217 |
| HTHS viscosity | 150° C. | mPa · s | 2.3 | 2.3 | 2.3 | 2.3 | 2.3 | 2.3 | 2.3 | 2.3 |
| Acid value | Initial stage | mgKOH/g | 2.4 | 2.3 | 2.1 | 2.5 | 2.5 | 2.2 | 2.2 | 1.9 |
| NOx injection test (at 155° C., for 32 hours) | Kinematic viscosity (at 40° C.) | mm2/s | 33.10 | 27.29 | 25.27 | 28.85 | 27.79 | 26.65 | 27.03 | 26.81 |
| | Percent increase in kinematic viscosity (at 40° C.) | % | −7.7 | 3.4 | 5.4 | 6.4 | 4.6 | 5.4 | 5.9 | 1.7 |
| | Acid value | mgKOH/g | 4.6 | 5.3 | 4.2 | 5.2 | 5.2 | 4.1 | 4.0 | 3.9 |
| | Increase in acid value | mgKOH/g | 2.2 | 3.0 | 2.1 | 2.7 | 2.6 | 1.9 | 1.8 | 2.0 |
| NOx injection test (at 155° C., for 48 hours) | Kinematic viscosity (at 40° C.) | mm2/s | 32.23 | 29.71 | 26.28 | 31.13 | 28.17 | 27.73 | 28.02 | 27.40 |
| | Percent increase in kinematic viscosity (at 40° C.) | % | −10.2 | 12.5 | 9.6 | 14.8 | 6.0 | 9.7 | 9.8 | 3.9 |
| | Acid value | mgKOH/g | 6.2 | 6.3 | 5.4 | 6.9 | 6.1 | 5.1 | 5.2 | 5.1 |
| | Increase in acid value | mgKOH/g | 3.8 | 4.0 | 3.3 | 4.4 | 3.6 | 2.9 | 3.0 | 3.2 |
| Friction coefficient (SRV, 50N) | 80° C. | | 0.058 | 0.058 | 0.056 | 0.054 | 0.063 | 0.059 | 0.055 | 0.065 |
| | 100° C. | | 0.058 | 0.058 | 0.058 | 0.054 | 0.063 | 0.054 | 0.052 | 0.063 |

Any of each test lubricating oil composition of Examples 1 to 25 had an amount of sulfated ash of 0.9 mass % or less, and showed good oxidative stability in which after NOx injection test, the increase in acid value and the percent increase in kinematic viscosity were less and good fuel efficiency in which the friction coefficient was 0.062 or less in the SRV test.

In Comparative Examples 1 to 3 and 5 to 6 in which the nitrogen management index exceeded 0.60, the percent increase in kinematic viscosity at 40° C. after the NOx injection test became higher, and in Comparative Examples 1 and 3, the increase in acid value also became higher; therefore a decrease in oxidative stability was confirmed.

In Comparative Example 4 in which the amount of sulfated ash exceeded 0.9 mass % and in Comparative Example 7 that was free from nitrogen-containing ashless friction modifiers, the friction coefficient in the SRV test became higher, and a decrease in fuel efficiency was confirmed.

FIG. 1 is a graph showing the relationship between the nitrogen management index and the percent increase in kinematic viscosity at 40° C. after the mixed gas was introduced continuously for 48 hours into the lubricating oil compositions of Examples 1 to 3 and Comparative Examples 1 to 3. It was demonstrated that the percent increase in kinematic viscosity at 40° C. after the mixed gas was continuously introduced for 48 hours was also larger as the nitrogen management index increased.

INDUSTRIAL APPLICABILITY

The lubricating oil composition for an internal combustion engine of the present invention can provide a lubricating oil composition for an internal combustion engine with improved fuel efficiency and oxidative stability, while maintaining low amount of sulfated ash.

The invention claimed is:

1. A lubricating oil composition for an internal combustion engine, comprising:

(A) a lubricant base oil with a kinematic viscosity at 100° C. of 2.0 $mm^2/s$ to 5.0 $mm^2/s$;

(B) 50 mass ppm to 2000 mass ppm of a molybdenum-based friction modifier based on a total amount of the composition as an amount of molybdenum;

(C) a nitrogen-containing ashless friction modifier;

(D) a succinimide or a derivative thereof as a dispersant;

(E) an amine ashless antioxidant as an antioxidant; and (F) 1000 mass ppm to 2200 mass ppm of a metallic detergent based on the total amount of the composition as an amount of metal, wherein the amount of sulfated ash based on the total amount of the composition is 0.9 mass % or less, wherein a nitrogen management index represented by the following formula is 0.60 or less:

formula (A): (N(B)*1.1+N(C)*1.9)/(N(D)+N(E)*1.2), wherein N(B) is an amount of nitrogen (mass ppm) derived from the molybdenum-based friction modifier based on the total amount of the composition, N(C) is an amount of nitrogen (mass ppm) derived from the nitrogen-containing ashless friction modifier based on the total amount of the composition, N(D) is an amount of nitrogen (mass ppm) derived from the succinimide or a derivative thereof based on the total amount of the composition, and N(E) is an amount of nitrogen (mass ppm) derived from the amine ashless antioxidant based on the total amount of the composition, and wherein N(C) is 10 mass ppm or more, N(D) is 350 mass ppm or more, and N(E) is 410 mass ppm or more.

2. The lubricating oil composition for an internal combustion engine according to claim 1, further comprising (G) a viscosity index improver, wherein the viscosity index improver has a Mw/Mn (weight-average molecular weight/number-average molecular weight) of 2.3 or more.

3. The lubricating oil composition for an internal combustion engine according to claim 1, wherein a content of the molybdenum-based friction modifier is 500 mass ppm to 1000 mass ppm based on the total amount of the composition as an amount of molybdenum.

4. The lubricating oil composition for an internal combustion engine according to claim 1, wherein the nitrogen-containing ashless friction modifier is at least one selected from an amino acid compound, an amine compound, a urea compound, and a fatty acid ester compound, having an alkyl group, an alkenyl group, or an acyl group with 12 to 30 carbon atoms, and derivatives thereof.

* * * * *